US005996540A

United States Patent [19]

Hara

[11] Patent Number: 5,996,540

[45] Date of Patent: Dec. 7, 1999

[54] VARIABLE VALVE TIMING AND LIFT SYSTEM

[75] Inventor: Seinosuke Hara, Kanagawa, Japan

[73] Assignee: Unisia Jecs Corporation, Atsugi, Japan

[21] Appl. No.: 09/055,284

[22] Filed: Apr. 6, 1998

[30] Foreign Application Priority Data

Apr. 4, 1997 [JP] Japan ..... 9-086155

[51] Int. Cl.[6] ..... F01L 13/00

[52] U.S. Cl. ..... 123/90.16; 123/90.17; 123/90.6

[58] Field of Search ..... 123/90.15, 90.16, 123/90.17, 90.22, 90.39, 90.6; 74/567, 568 R

[56] References Cited

U.S. PATENT DOCUMENTS

| | | | |
|---|---|---|---|
| 4,397,270 | 8/1983 | Aoyama | 123/90.16 |
| 4,572,118 | 2/1986 | Baguena | 123/90.16 |
| 5,148,783 | 9/1992 | Shinkai et al. | 123/90.16 |
| 5,431,132 | 7/1995 | Kreuter et al. | 123/90.16 |
| 5,586,527 | 12/1996 | Kreuter | 123/90.15 |
| 5,592,906 | 1/1997 | Kreuter et al. | 123/90.16 |
| 5,732,669 | 3/1998 | Fischer et al. | 123/90.16 |
| 5,787,849 | 8/1998 | Mitchell | 123/90.17 |
| 5,899,180 | 5/1999 | Fischer | 123/90.16 |

FOREIGN PATENT DOCUMENTS 55-137305 10/1980 Japan .

*Primary Examiner*—Weilun Lo
*Attorney, Agent, or Firm*—Foley & Lardner

[57] ABSTRACT

A variable valve timing and lift system comprises a camshaft having a rotary cam and a valve operating (VO) cam, and a control rod having an integral portion. The integral portion in the form of an eccentric cam supports a rocker arm. The rotary cam is fixed to the camshaft. The VO cam is in contact with a valve lifter for a cylinder valve of an engine. A torsion spring winds about the camshaft to apply a bias to the VO cam. The rocker arm has a first arm cooperating with the rotary cam and a second arm cooperating with a projecting radial lever of the VO cam. Under the action of the torsion spring, the lever of the VO cam is held in engagement with the second arm of the rocker arm and the second arm of the rocker arm is held in engagement with the rotary cam.

18 Claims, 10 Drawing Sheets

VARIABLE VALVE TIMING AND LIFT SYSTEM

BACKGROUND OF THE INVENTION

1. Field of the Invention

The present invention relates to a system for operating a cylinder valve of an internal combustion engine, and more particularly to a variable valve timing and lift system which can change both valve timing and valve lift.

2. Description of the Prior Art

JP-A 55-137305 discloses a variable valve timing and lift system. It includes a camshaft, a control rod with axially spaced eccentric cams, and a pivot structure. The pivot structure supports valve operating (VO) cams for pivotal motion above valve lifters of cylinder valves. Springs are mounted to the VO cams, respectively. Each of the springs biases one of the corresponding rocker cams toward its rest position where the associated cylinder valve closes. Rocker arms operate the VO cams, respectively. The eccentric cams, which are in rotary unison with the control rod, bear the rocker arms, respectively. An axis of each of the eccentric cams serves as the center of drive of the corresponding one of the rocker arms. Cams on the camshaft operate the rocker arms, respectively. An electronic control module (ECM) is provided. Sensors on the engine send information on engine speed, engine load, vehicle speed, and coolant temperature to the ECM. At a predetermined switchover point, the ECM sends a signal to an actuator for the control rod. As the actuator turns the control rod, the eccentricity of each of the eccentric cams with respect to an axis of the control shaft changes. This alters the position of pivot center of the rocker arms relative to the position of pivot center of the VO cams. This causes variation in valve timing and lift of each of the cylinder valves.

According to this known system, the camshaft is not mounted above the cylinder valves. This arrangement has a potential problem in that considerable modification of the conventional overhead camshaft engine is required to install the camshaft. Besides, the pivot structure and camshaft require a considerable space to install.

SUMMARY OF THE INVENTION

An object of the present invention is to provide a space saving structure of a variable valve timing and lift system of the above kind, which can be installed on a conventional overhead camshaft engine without any substantial modification to the engine except the design of its cylinder head.

According to the present invention, there is provided a variable valve timing and lift system for an engine having a plurality of cylinder valves, comprising:

a camshaft having a camshaft axis, the camshaft having a rotary cam fixed thereto for unitary rotation about the camshaft axis;

a valve operating (VO) cam for a cylinder valve of an engine;

a rocker arm; and a control rod having an integral portion, the integral portion supporting the rocker arm for pivotal motion about an axis stationary relative to the integral portion;

the rocker arm having a first arm cooperating with the rotary cam and a second arm cooperating with the valve operating cam;

the camshaft supporting the VO cam for pivotal motion about the camshaft axis.

DESCRIPTION OF THE PREFERRED EMBODIMENTS

Figure 1:
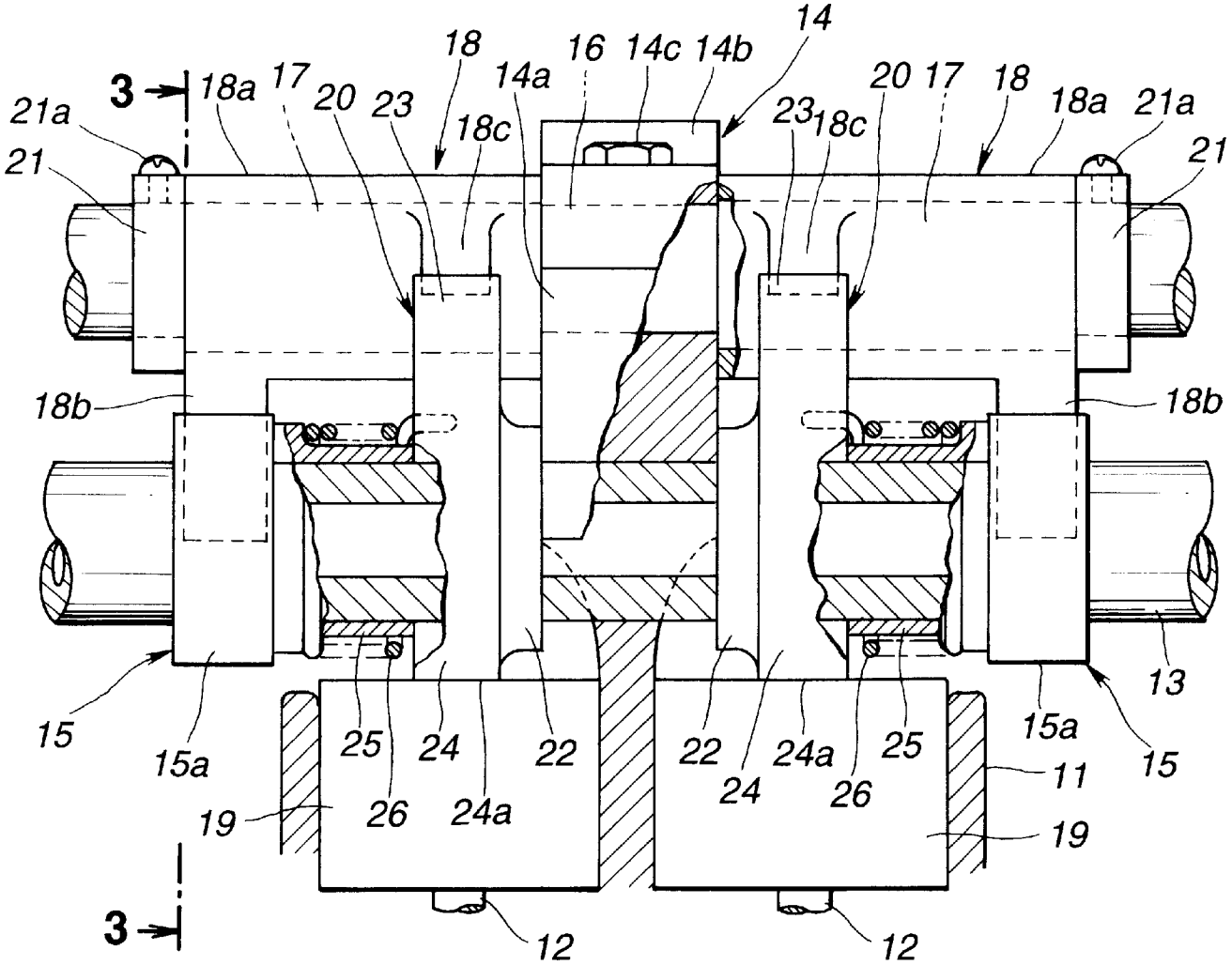
FIG. 1 is a fragmentary, partly broken away, view of a first embodiment of a variable valve timing and lift system according to the present invention.

Referring to the accompanying drawings, like reference numerals and characters are used throughout all of the Figures to denote like or similar parts or portions for the sake of simplicity of description.

Figure 2:
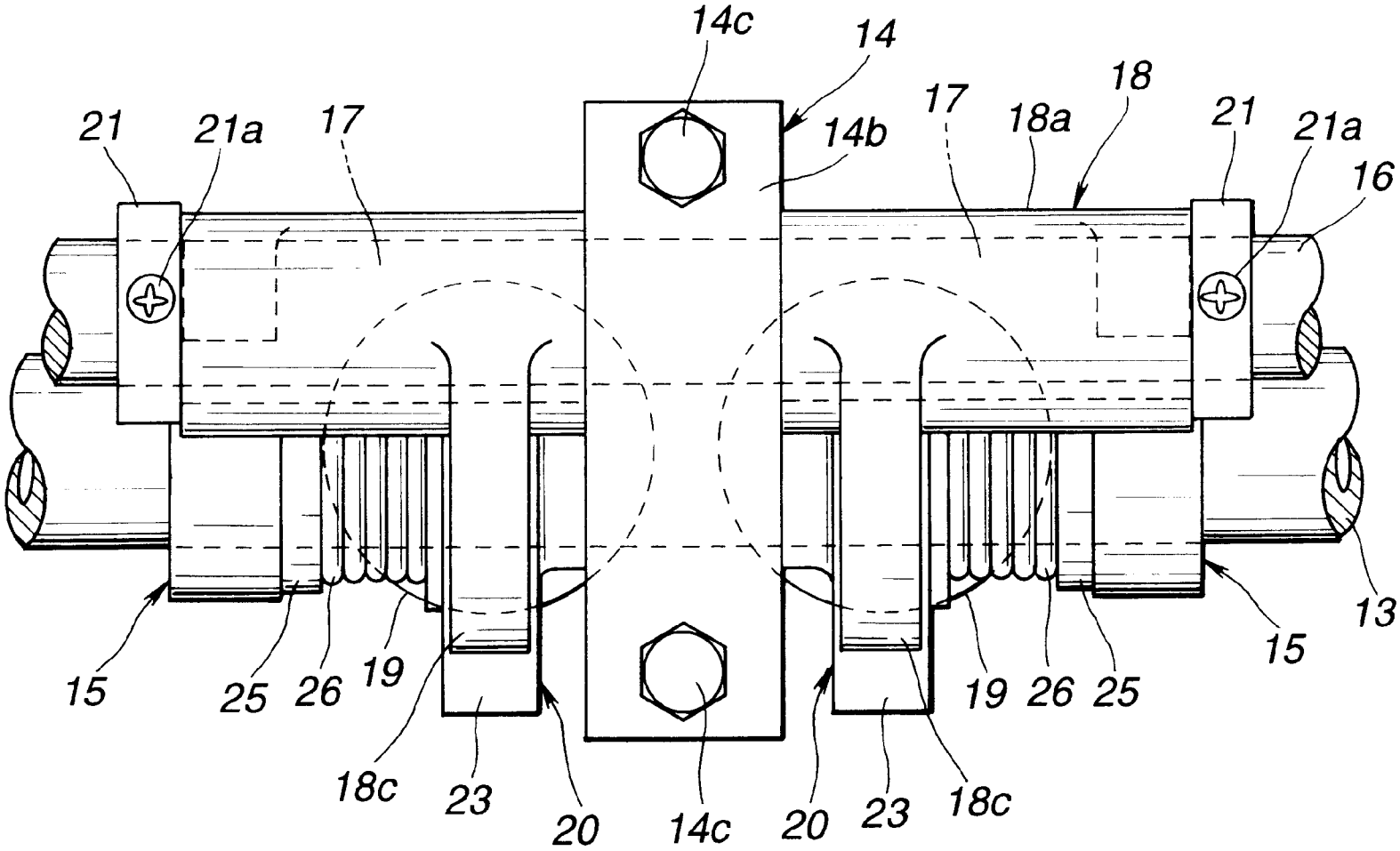
FIG. 2 is a top plan view of the system shown in FIG. 1.
Figure 3:
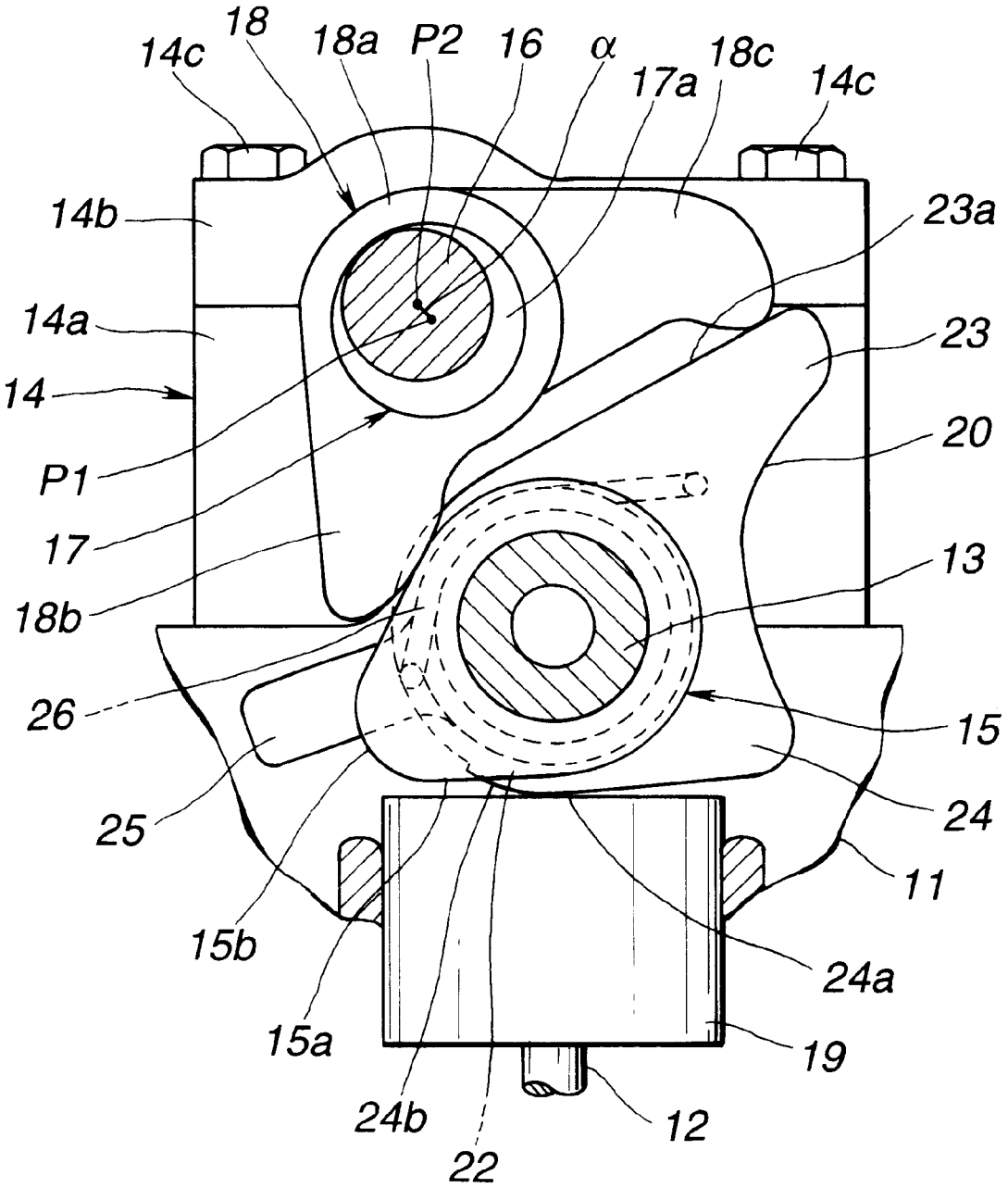
FIG. 3 is a section taken through the line 3—3 in FIG. 1.

Referring to FIGS. 1 to 3, the reference numeral 11 designates a cylinder head of an overhead camshaft internal combustion engine. The engine has four cylinder valves per each cylinder. They include two intake valves 12, 12 and two exhaust valves (not shown). Valve guides, not shown, of the cylinder head 11 support the intake valves 12, 12, respectively.

A variable valve timing and lift system implementing the present invention includes at least one cylinder valve that opens when a cylinder performs an intake phase or an exhaust phase. The system is described hereinafter in detail taking the intake valves 12, 12 as an example of the cylinder valves.

Cam bearings, only one being shown at 14, on the cylinder head 11 support a camshaft 13, which is hollowed (see FIG. 3), and a control rod 16. As seen in FIG. 3, the camshaft 13 is disposed above and in the proximity of valve lifters 19, 19 for the intake valves 12, 12. The cam bearing 14 includes a main bracket 14*a* that holds the camshaft 13 on the cylinder head 11. A subordinate bracket 14*b* holds the control rod 16 on the main bracket 14*a* in spaced relationship with the camshaft 13. A pair of fasteners in the form of bolts 14*c* (see FIG. 2) securely fastens the brackets 14*a* and 14*b* to the cylinder head 11. A crankshaft (not shown) provides drive force from the engine to the camshaft 13 via pulleys and a timing chain in the conventional manner. The camshaft 13 extends from a front end of the cylinder head to a rear end thereof.

The camshaft 13 has axially spaced rotary cams 15, 15. The rotary cams 15, 15 are fixed to the camshaft 13. As best seen in FIG. 1, two rotary cams 15, 15 are provided for the corresponding two intake valves 12, 12, respectively, for each cylinder. They are axially spaced from each other and out of interference with valve lifters 19, 19 for the intake valves 12, 12. Each rotary cam 15 has a peripheral surface 15*a*. The peripheral surface 15*a* consists of a first portion defining part of a base circle and a second portion defining a lobe 15*b*. In this embodiment, the two rotary cams 15, 15 for each cylinder are identical in configuration and have the same profile. If desired, they may have different cam profiles.

As shown in FIGS. 1 and 2, the rotary cams 15, 15 are axially spaced in directions away from the cam bearing 14 to allow layout of valve operating (VO) cams 20, 20 for contact with the valve lifters 19, 19. As seen in FIG. 1, the VO cams 20, 20 on the left and right sides of the cam bearing 14 are not identical in configuration. They are in mirror image relationship with respect to a hypothetical vertical plane bisecting the cam bearing 14. Specifically, the VO cams 20, 20 that are in mirror image relationship have hubs 22, 22 projecting toward each other for abutting contact with one and the opposite faces of the cam bearing 14. Besides, on the remotest sides of the hubs 22, 22 from the cam bearing 14, the VO cams 20, 20 face sleeves of the adjacent spring retainers 25, 25, respectively. In this embodiment, the VO cams 20 that are in mirror image relationship have the same profile as shown in FIG. 3 although they may have different profiles, if desired.

The camshaft 13 extends through the sleeves of the spring retainers 25 and the hubs 22 of the VO cams 20. The spring retainers 25 are held stationary relative to the cylinder head 11 by appropriate means. Rotation of the camshaft 13 about a camshaft axis will apply no torque or the least torque, if any, to the spring retainers 25 and the VO cams 20. The VO cams 20 can pivot about the camshaft axis.

As best seen in FIG. 3, the VO cam 20 has a peripheral cam surface in driving contact with the valve lifter 19. The peripheral cam surface consists of a first portion 24*b* that defines part of a base circle about the camshaft axis and a second portion 24*a* that defines a contour of a cam lobe 24. The first portion 24*b* merges smoothly into the second portion 24*a*. The VO cam 20 has a projecting radial lever 23 having a slope 23*a* facing control rod 16.

The control rod 16 has a control rod axis P2. It has integral portions in the form of circular or eccentric cams 17. The eccentric cams 17 support rocker arms 18, respectively, for pivotal motion. The eccentric cams 17 are axially spaced and fixed to the control rod 16 for unitary rotation about the control rod axis P2. Each of the eccentric cams 17 has an eccentric cam axis P1 that is displaced by an amount (alpha) from the control rod axis P2 (see FIG. 3). The rocker arms 18 have sleeves 18*a* that receive the eccentric cams 17, respectively. The sleeves 18*a* can rotate about the cam axis P1 relative to the corresponding eccentric cams 17.

As seen in FIGS. 1 and 2, the rocker arms 18, 18 on the left and right sides of the cam bearing 14 are not identical but are in mirror image relationship with respect to the hypothetical vertical plane bisecting the cam bearing 14. Specifically, the two rocker arms 18, 18 that are in mirror image relationship have first arms 18*b*, 18*b* and second arms 18*c*, 18*c*. The first arms 18*b*, 18*b* extend from and define the remotest ends of the sleeves 18*a*, 18*a* of the left and right rocker arms 18, 18 from the cam bearing 14. The second arms 18*c*, 18*c* extend from portions adjacent the nearest ends of the sleeves 18*a*, 18*a* of the left and right rocker arms 18, 18 to the cam bearing 14. In this embodiment, the rocker arms 18, 18 that are in mirror image relationship have the same profile as shown in FIG. 3 although they may have different profiles, if desired. Stop rings 20, 20 are fixed to the control rod 16 by fasteners in the form of screws 21*a*, 21*a* to prevent the rocker arms 18, 18 from moving axially apart from the cam bearing 14.

The first arms 18*b* extend toward the rotary cams 15, respectively, for cooperation with the peripheral surfaces 15*a*. The second arms 18*c* extend toward the levers 23 of the VO cams 20 for cooperation with the slopes 23*a*. Springs 26 are provided to maintain contact of the slopes 23*a* of the VO cams 20 with the second arms 18*c* of the rocker arms 18, urging the rocker arms 18 to maintain contact of the first arms 18*b* with the rotary cams 15. Rotation of the rotary cams 15 causes the rocker arms 18 to pivot about the eccentric cam axis P1. As the rocker arms 18 pivot, the second arms 18*c* slide on the slopes 23*a*, causing the VO cams 20 to pivot about the camshaft axis. This pivotal motions of the VO cams 20 causes the valve lifters 19 to reciprocate.

Referring to FIG. 1, each of the springs 26 is in the form of a torsion spring. The springs 26 wind around the sleeves of the spring retainers 25, respectively. At one end of each of the springs 26 is anchored to the corresponding one of the spring retainers 25 that is held stationary to the cylinder head 11. The opposite end of each of the springs 26 is anchored to the corresponding one of the VO cams 20 to bias the lever 23 against the second arm 18*c* of the corresponding one of the rocker arms 18.

Figure 6:
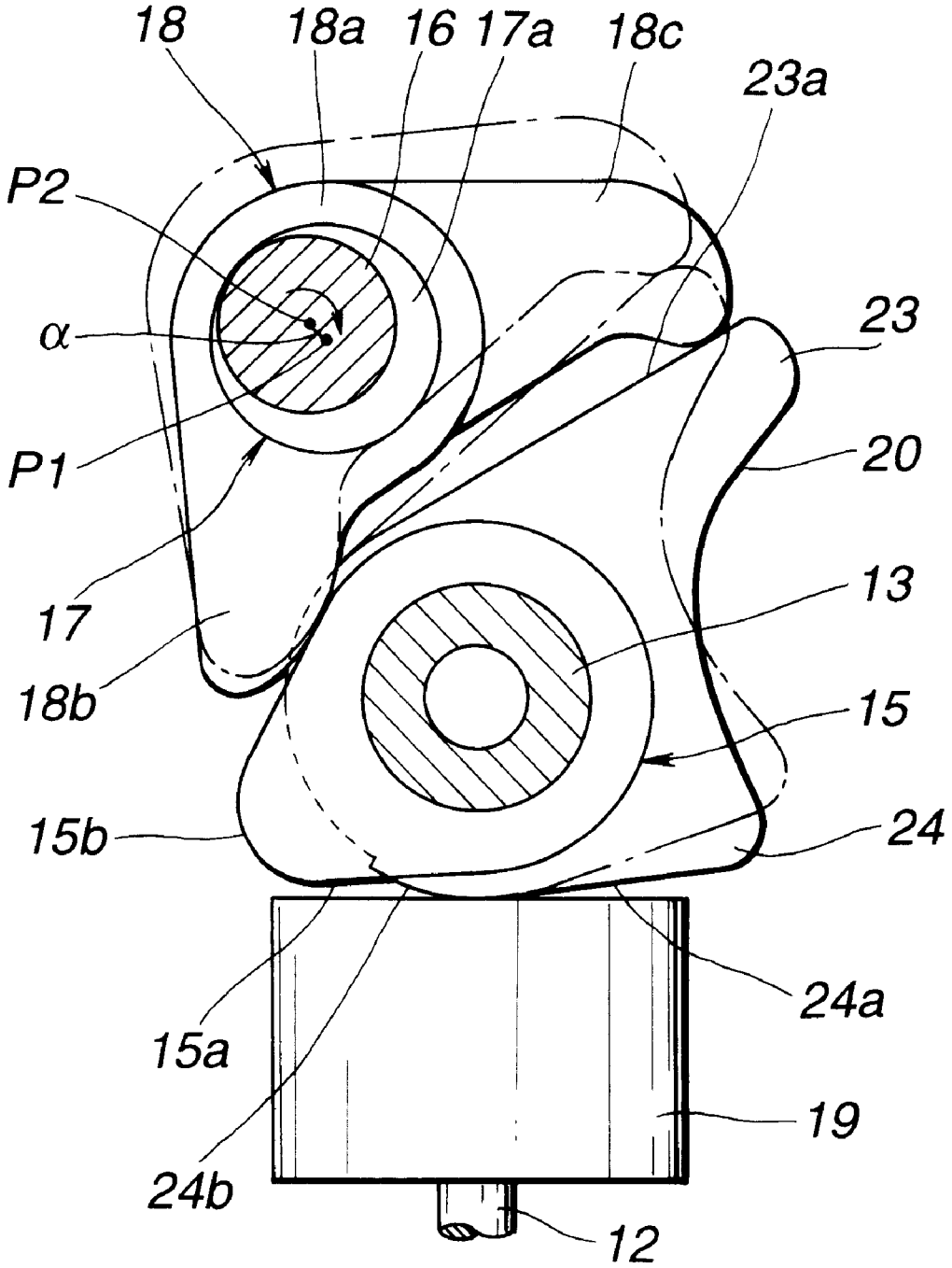
FIGS. 6 and 7 are similar views to FIGS. 4 and 5, respectively, showing the positions at high engine speed.
Figure 8:
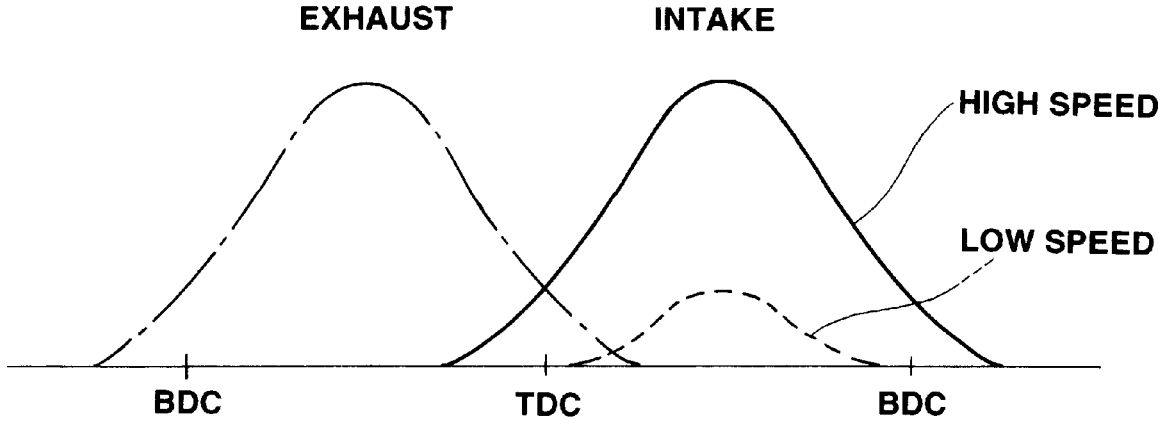
FIG. 8 is a valve lift diagram of the cylinder valve at high engine rpm together with that at low engine speed.

Referring to FIG. 8, the fully drawn line curve is a valve lift diagram, which is given when the control rod 16 is held at an angular position as shown in FIG. 3. The fully drawn line in FIG. 6 shows the same position of parts shown in FIG. 3. The broken line curve in FIG. 8 is a valve lift diagram, which is given when the control rod 16 is held at another angular position as shown in FIG. 4.

An actuator in the form of an electromagnetic actuator, not shown, is drivingly coupled with the control rod 16. An electronic control module (ECM) or a controller, not shown, is provided. Sensors on the engine send information on engine speed, engine load, vehicle speed, and coolant temperature to the ECM. At a predetermined switchover point, the ECM sends a signal to the actuator to rotate the control rod 16.

Figure 4:
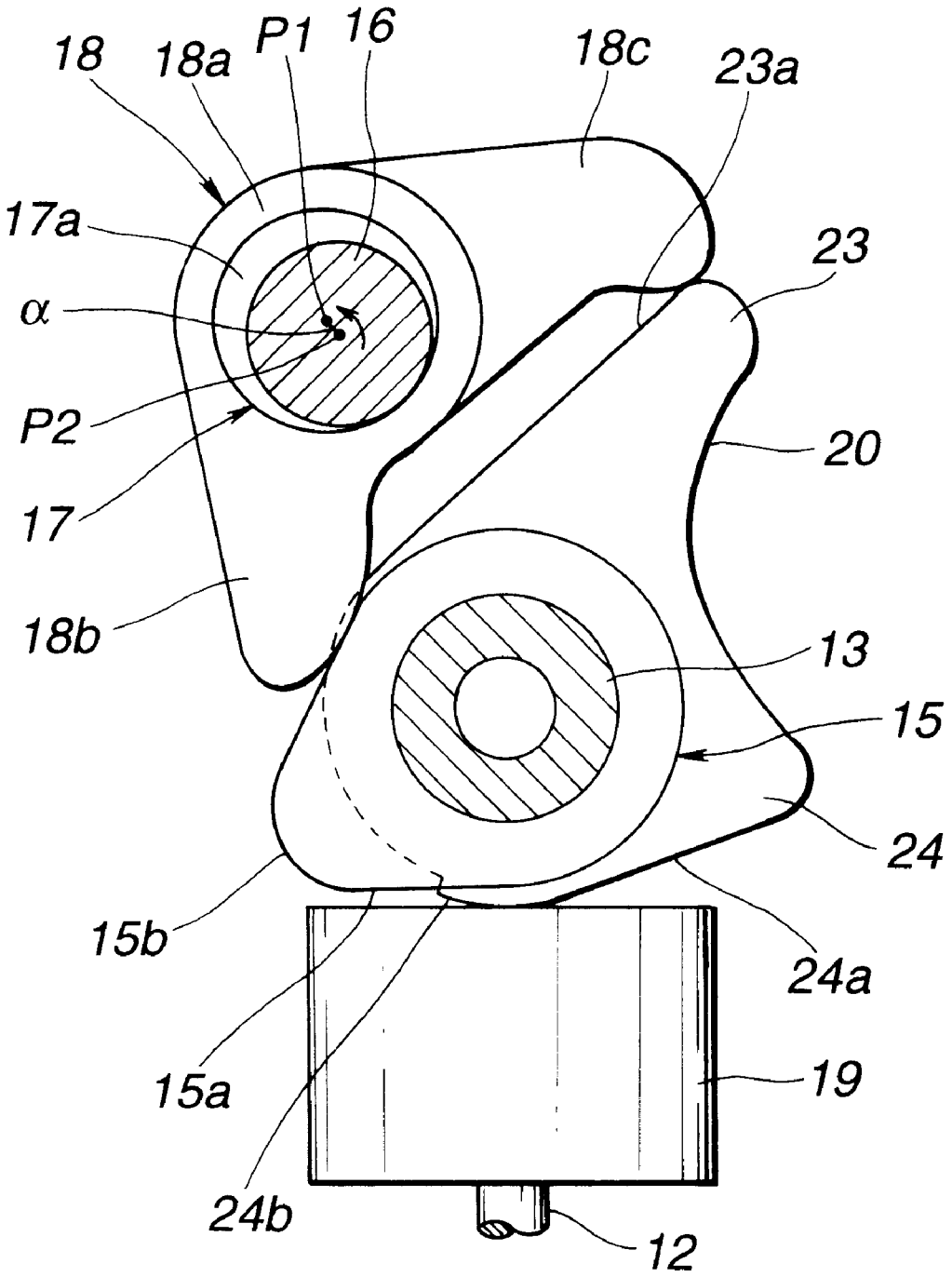
FIGS. 4 and 5 are similar views to FIG. 3 showing a rest position where a cylinder valve closes and a lifted position where the valve opens at low engine speed.

In this embodiment, the actuator turns the control rod 16 through 180 degrees between the position of FIG. 6 and the position of FIG. 4. During a shift from the position of FIG. 6 to the position of FIG. 4, a thickened portion 17*a* of the eccentric cam 17 orbits about the control rod axis P2 as the control rod 16 turns through 180 degrees. As a result of this shift, the direction of eccentricity of the eccentric cam axis P1 with respect to the control rod axis P2 changes through 180 degrees and a displacement of the eccentric cam axis P1 amounts to $2\alpha$. This displacement of the eccentric cam axis P1 results in the displacement of the axis of rotation of each of the rocker arms 18 by the same amount. This causes the rocker arm 18 to displace in a counterclockwise angular direction about the displaced axis of rotation P1 (see FIG. 4) to assume the position as illustrated by phantom line in FIG. 6. The VO cam 20 follows the displacement of the rocker arm 18 and displaces in a counterclockwise angular direction to the new position as illustrated by the phantom line in FIG. 6.

Figure 5:
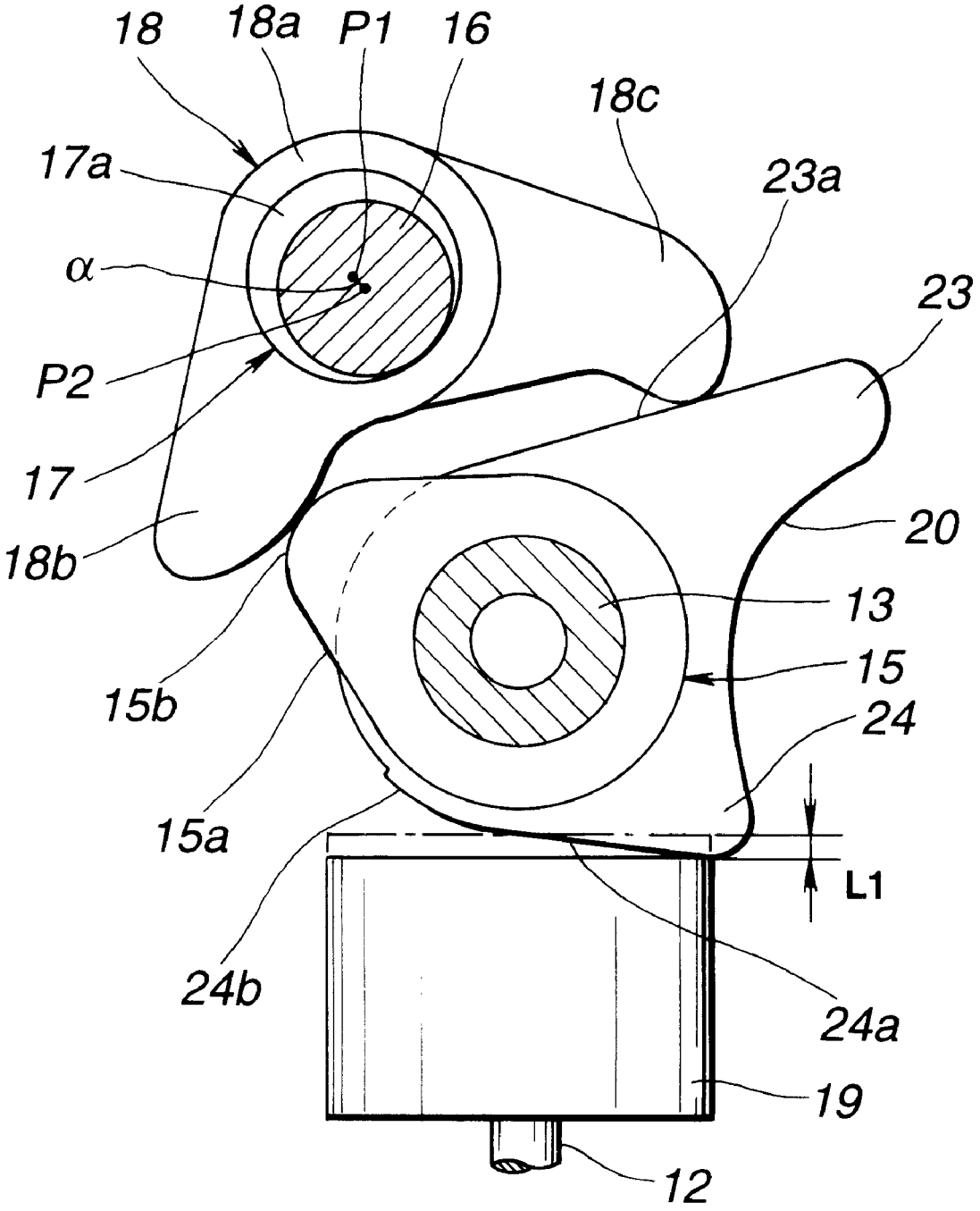
Figure 7:
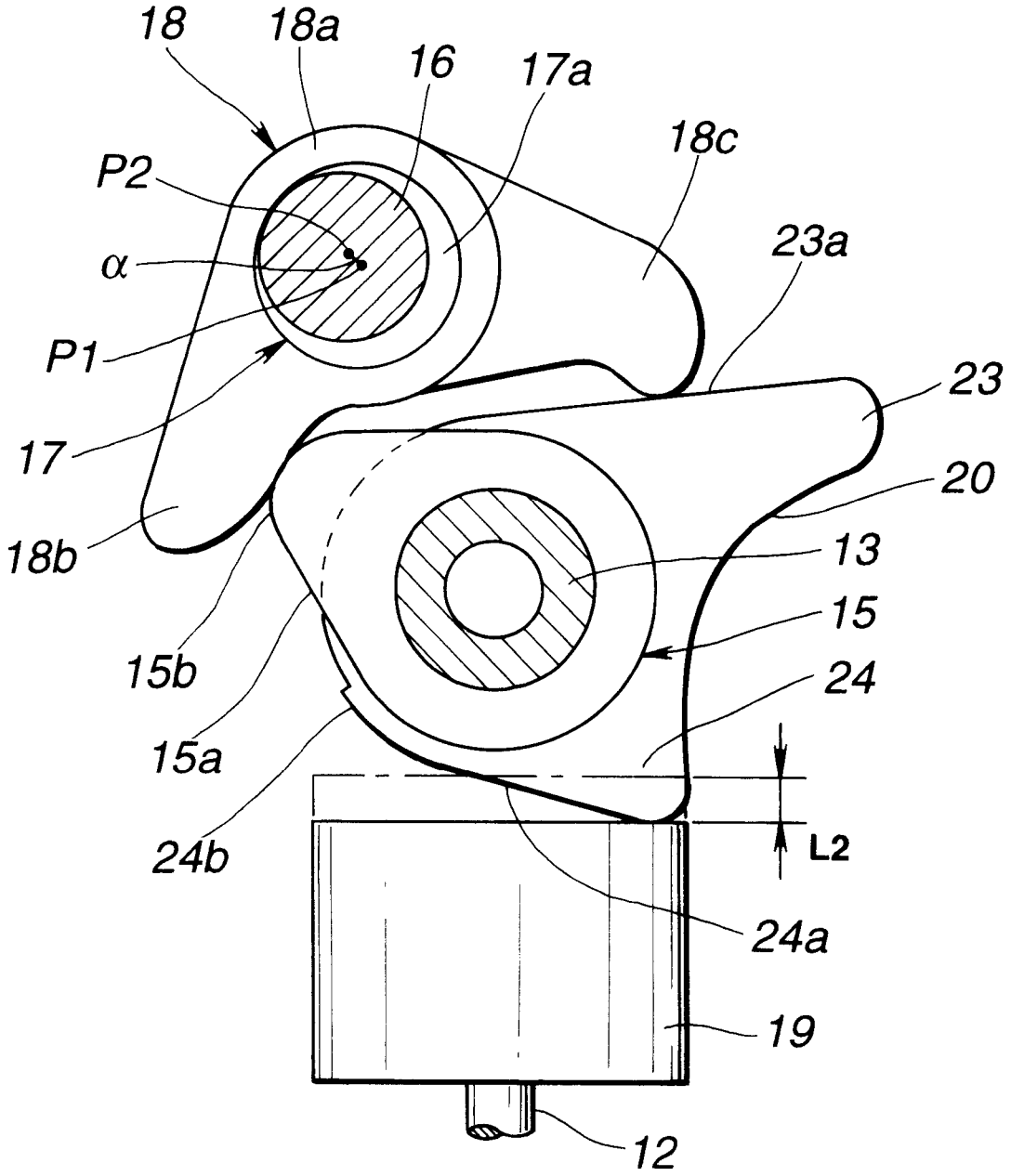

Referring to FIGS. 4 to 7 and FIG. 8, FIG. 6 shows a position of parts when the camshaft 13 advances to a first predetermined angle immediately before the valve lifter 19 begins to open the intake valve 12. FIG. 7 shows a position of parts when the camshaft 13 advances further to a second predetermined angle at which the valve lifter 19 has been lifted by its maximum amount L2. FIG. 4 shows a position of parts when the camshaft 13 advances to the first predetermined angle. FIG. 5 shows a position of parts when the camshaft 13 advances to the second predetermined angle at which the valve lifter 19 has been lifted by its maximum amount L1 that is less than L2.

Suppose the eccentric cam axis P1 takes the position as illustrated in FIGS. 6 and 7. Under this condition, the VO cam 20 pivots clockwise from the position of FIG. 6 to the position of FIG. 7 due to the action of the rocker arm 18 as the camshaft 13 rotates clockwise from the position of FIG. 6 to the position of FIG. 7. Further clockwise rotation of the camshaft 13 beyond the position of FIG. 7 allows the VO cam 20 to pivot counterclockwise from the position of FIG. 7 to the position of FIG. 6. This causes the intake valve 12 to open as illustrated by fully drawn valve lift diagram in FIG. 8.

Suppose the eccentric cam axis P1 takes the position as illustrated in FIGS. 4 and 5. Under this condition, the VO cam 20 pivots clockwise from the position of FIG. 4 to the position of FIG. 5 due to the action of the rocker arm 18 as the camshaft 13 rotates clockwise from the position of FIG, 4 to the position of FIG. 5. Further clockwise rotation of the camshaft 13 beyond the position of FIG. 5 allows the VO cam 20 to pivot counterclockwise from the position of FIG. 5 to the position of FIG. 4. Clockwise from the potion of the VO cam 20 from the position of FIG. 4 to the position of FIG. 6 does not cause any lift of the valve lifter 19. This results in delayed open timing of the intake valve 12. Counterclockwise pivotal motion of the VO cam 20 from the position of FIG. 6 to the position of FIG. 4 does not cause any lift of the valve lifter 19. This results in advanced close timing of the intake valve 12. The valve lift has been reduced from L2 to L1 because the VO cam 20 does not pivot to the position of FIG. 7 and the contour 24*a* of the cam lobe 24 is not fully utilized to lift the valve lifter 19. Thus, as shown in FIG. 8, the broken line drawn valve lift diagram with reduced valve duration and reduced valve lift is provided.

The fully drawn valve lift diagram in FIG. 8 is suitable for engine operation at high speed with heavy load, while the broken line drawn valve lift diagram is suitable for engine operation at low speed with light load. In FIG. 8, one-dot chain line drawn curve is a valve lift diagram of exhaust valves. It is appreciated from FIG. 8 that both the valve overlap and valve lift are reduced during operation of the engine at low speed with light load to provide stable operation with good fuel economy. During operation at high speed with heavy load, sufficiently high volumetric efficiency is provided.

From the preceding description of the first embodiment, it is appreciated that the VO cams 20 and the rotary cams 15 are mounted on the camshaft 13 in coaxial manner. This arrangement has eliminated or at least minimized any additional space that has been required around the camshaft.

Besides, the rocker arms 18 are neatly arranged in a space in the proximity of the camshaft 13. In this manner, the VO cams 20 and the rocker arms 18 are arranged within a small space around the camshaft 13. This results in easy installation of the system on the engine. Besides, the camshaft 13 can be mounted in the conventional position and manner on the engine. This also facilitates easy installation.

The coaxial arrangement of the VO cams 20 with the axis of the camshaft 13 prevents occurrence of misalignment of the axis of each of the VO cams 20 with the axis of the camshaft 13. This keeps the accuracy of valve timing at high level. Compared with the prior art discussed before, the proposed mount of the VO cams on the camshaft is advantageous because the pivot structure required in the prior art is no longer needed.

The rotary cams 15 on the camshaft 13 are arranged in spaces that are offset from and thus out of interference with the valve lifters 19. This layout allows the use of a rotary cam having a lobe that provides a sufficiently great amount of lift and having a width that is wide enough to reduce contact pressure to a sufficiently low level.

The torsion springs 26 keep the VO cams 20, rocker arms 18 and rotary cams 15 in contact with each other Hammering and thus operation noise will not take place.

The torsion springs 26 are neatly arranged around the camshaft 13, thus making it unnecessary to provide additional spaces for springs biasing VO cams.

Figure 9:
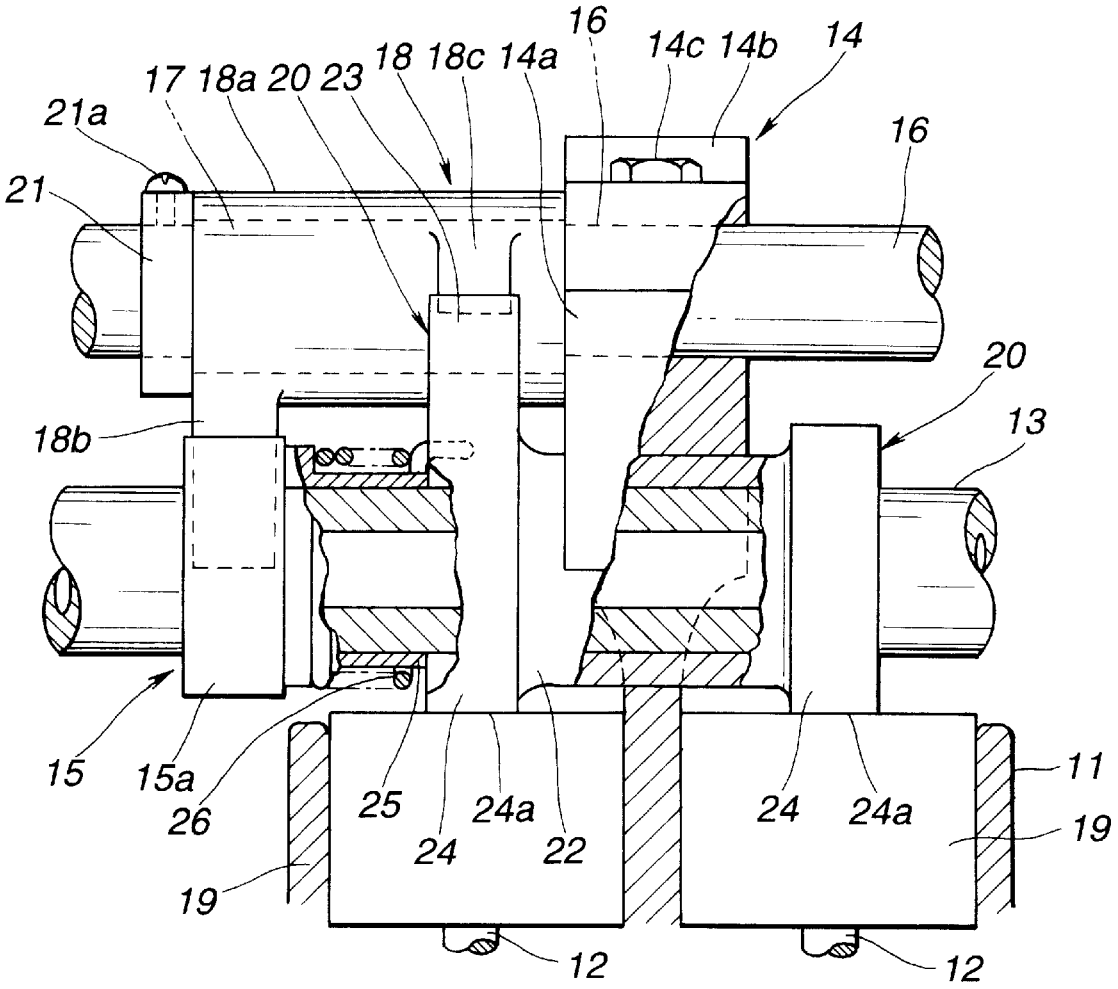
FIGS. 9 and 10 are similar views to FIGS. 1 and 2, respectively, showing a second embodiment.
Figure 10:
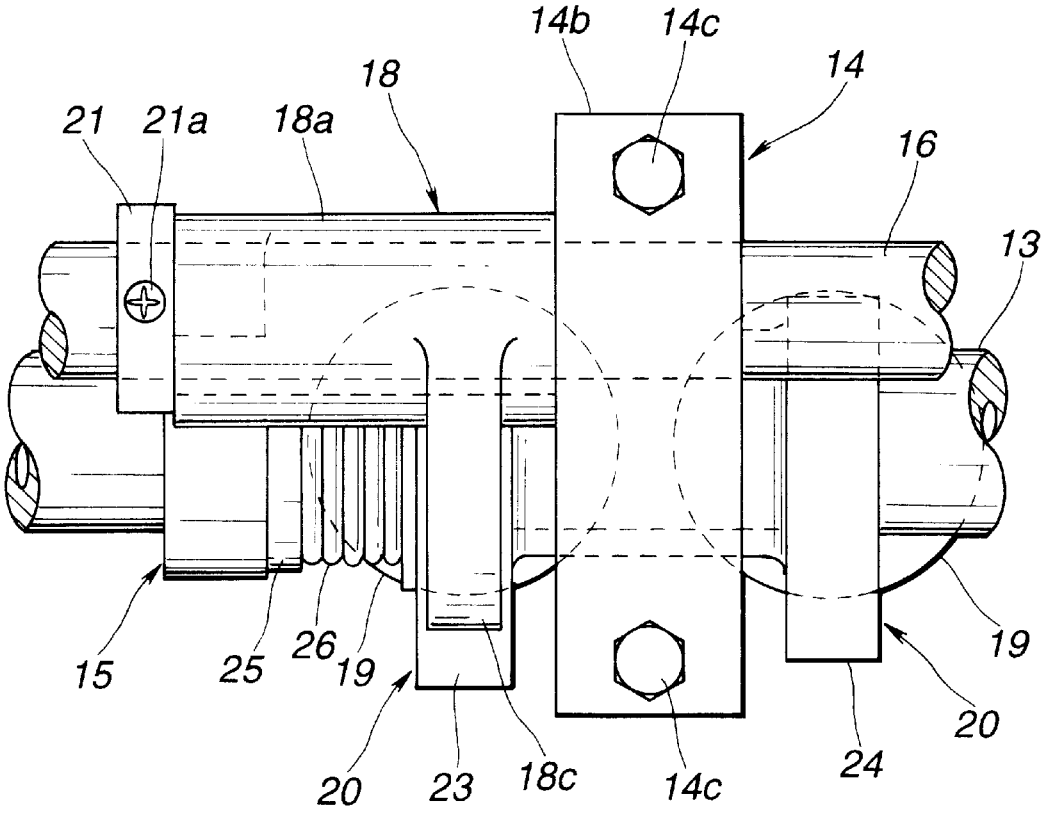

FIGS. 9 and 10 shows the second embodiment. This embodiment is substantially the same as the first embodiment. However, the former is different from the latter in that, for each cylinder, VO cams 20, 20 for cylinder valves in the form of intake valves 12 are integrated to pivot as a unit about an axis of a camshaft 13. Thus, a rotary cam 15, a rocker arm 18 and a torsion spring 26 only are required per each cylinder to operate the two VO cams 20, 20.

The two VO cams 20, 20 have a hub 22 in common. Viewing in FIGS. 9 and 10, the VO cam 20 on the right side of a cam bearing 14 is not provided with a lever 23 for cooperation with the rocker arm 18.

In this embodiment, lobes 24, 24 of the VO cams 20, 20 are identical. However, two different lobes may be used, if desired. If two different lobes that provide different amounts of lift are used, a desired swirl can be generated in the cylinder.

Although in the first and second embodiments, the two intake valves per each cylinder are used in explaining the inventions, the present invention may be applied to two exhaust valves per each cylinder. Further, the present invention may be applied to both intake and exhaust valves per each cylinder. Furthermore, the present invention may be applied to one cylinder valve, which may be an intake valve or an exhaust valve, per cylinder.

What is claimed is:

1. A variable valve timing and lift system for an engine having a plurality of cylinder valves, comprising:

a camshaft having a camshaft axis, said camshaft having a rotary cam fixed thereto for unitary rotation about said camshaft axis;

a valve operating (VO) cam for a cylinder valve of an engine;

a rocker arm; and a control rod having an integral portion, said integral portion supporting said rocker arm for pivotal motion about an axis stationary relative to said integral portion;

said rocker arm having a first arm cooperating with said rotary cam and a second arm cooperating with said valve operating cam;

said camshaft supporting said VO cam for pivotal motion about said camshaft axis.

2. The system as claimed in claim 1, wherein said rotary cam is axially spaced from said VO cam along said camshaft axis.

3. The system as claimed in claim 1, including a valve lifter disposed between said VO cam and one of the cylinder valves.

4. The system as claimed in claim 3, wherein said rotary cam is out of interference with said valve lifter.

5. The system as claimed in claim 1, wherein said rotary cam is disposed between two adjacent cylinders of the engine.

6. The system as claimed in claim 1, further comprising a spring winding around said camshaft and biasing said VO cam into contact with said second arm of said rocker arm.

7. The system as claimed in claim 1, further comprising:

a second VO cam for a second cylinder valve of the engine, the first mentioned cylinder valve and the second cylinder valve being provided for a common cylinder.

8. The system as claimed in claim 7, wherein said first mentioned VO cam and said second VO cam have different lobes in profile.

9. The system as claimed in claim 7, wherein said camshaft has a second rotary cam fixed thereto for unitary rotation and further comprising a second rocker arm having a first arm thereof cooperating with said second rotary cam and a second arm thereof cooperating with said second VO cam.

10. The system as claimed in claim 9, wherein said first mentioned rotary cam and said second rotary cam have different lobes in profile.

11. The system as claimed in claim 7, wherein said second VO cam is integrated with said first mentioned VO cam for unitary motion therewith.

12. The system as claimed in claim 1, wherein said rocker arm has a sleeve that receives said integral portion of said control rod, and said first and second arms extend from said sleeve toward said rotary cam and said VO cam, respectively.

13. The system as claimed in claim 12, wherein said integral portion is in the form of an eccentric cam having an eccentric cam axis, and said rocker arm is pivotal about said eccentric cam axis.

14. The system as claimed in claim 13, wherein said control rod has a control rod axis and said eccentric cam axis is eccentric with respect to said control rod axis.

15. The system as claimed in claim 14, wherein said VO cam has a projecting lever with a slope for engagement with said second arm of said rocker arm.

16. The system as claimed in claim 15, further comprising a stationary spring retainer having a sleeve that receives said camshaft, and a torsion spring winding around said sleeve of said torsion spring, said torsion spring having one end anchored to said spring retainer and opposite end anchored to said VO cam to bias said projecting lever against said second arm of said rocker arm.

17. The system as claimed in claim 16, wherein said rotary cam has a lobe and is held in engagement with said first arm of said rocker arm under the action of said torsion spring.

18. The system as claimed in claim 17, wherein rotation of said control rod about said control rod axis causes a change in direction of eccentricity of said eccentric cam axis with respect to said control rod axis, and said change causes a change in angular position of said VO cam relative to said rocker arm.

* * * * *